US008342238B2

(12) United States Patent
McCoy et al.

(10) Patent No.: US 8,342,238 B2
(45) Date of Patent: Jan. 1, 2013

(54) COAXIAL ELECTRIC SUBMERSIBLE PUMP FLOW METER

(75) Inventors: Robert H. McCoy, Talala, OK (US); Gordon Lee Besser, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 12/578,390

(22) Filed: Oct. 13, 2009

(65) Prior Publication Data

US 2011/0083839 A1 Apr. 14, 2011

(51) Int. Cl.
*E21B 47/01* (2006.01)

(52) U.S. Cl. ..... 166/105; 166/250.01; 417/423.14

(58) Field of Classification Search ..... 166/68, 166/68.5, 62, 105, 250.01; 73/861.63, 861.64; 417/423.3, 423.14
See application file for complete search history.

(56) References Cited

U.S. PATENT DOCUMENTS

| | | | | |
|---|---|---|---|---|
| 1,126,275 | A * | 1/1915 | Rice | 73/861.64 |
| 3,196,680 | A * | 7/1965 | Curran | 73/861.52 |
| 4,644,800 | A * | 2/1987 | Kozlak | 73/861.64 |
| 4,839,644 | A | 6/1989 | Safinya et al. | |
| 4,928,758 | A | 5/1990 | Siegfried, II | |
| 5,693,891 | A | 12/1997 | Brown et al. | |
| 5,736,650 | A | 4/1998 | Hiron et al. | |
| 6,176,308 | B1 * | 1/2001 | Pearson | 166/65.1 |
| 6,314,821 | B1 * | 11/2001 | Allan | 73/861.52 |
| 6,604,581 | B2 | 8/2003 | Moake et al. | |
| 6,755,247 | B2 | 6/2004 | Moake et al. | |
| 6,860,325 | B2 | 3/2005 | Ramakrishnan et al. | |
| 6,935,189 | B2 | 8/2005 | Richards | |
| 7,047,822 | B2 * | 5/2006 | Good et al. | 73/861.52 |
| 7,107,860 | B2 | 9/2006 | Jones | |
| 7,258,164 | B2 | 8/2007 | Rezgui et al. | |
| 7,293,471 | B2 * | 11/2007 | Lund Bo et al. | 73/861.52 |
| 2003/0010135 | A1 | 1/2003 | Maxit et al. | |
| 2003/0192689 | A1 | 10/2003 | Moake et al. | |
| 2004/0031330 | A1 * | 2/2004 | Richards et al. | 73/861.21 |
| 2006/0196674 | A1 | 9/2006 | Butler et al. | |
| 2007/0051509 | A1 * | 3/2007 | Selph | 166/105 |
| 2007/0193373 | A1 | 8/2007 | Xie et al. | |
| 2008/0098825 | A1 | 5/2008 | Huntsman et al. | |
| 2009/0242197 | A1 | 10/2009 | Hackworth et al. | |

FOREIGN PATENT DOCUMENTS

EP 0235032 2/1987

(Continued)

OTHER PUBLICATIONS

Baker Hughes Production Quest product information on SureFlo-V; 2006, 2 pages.

(Continued)

*Primary Examiner* — Jennifer H Gay
*Assistant Examiner* — Blake Michener
(74) *Attorney, Agent, or Firm* — Steve Rosenblatt

(57) ABSTRACT

A venturi structure is supported below an ESP preferably off its gauge assembly below its motor so that the surrounding casing or wellbore defines the venturi path leading to the suction connection of the ESP. Multiple pressure sensing locations are provided in case the gauge that defines the venturi path is disposed off center in the bore or if the bore is on an incline. The gauge can receive forms of different sizes depending on the size of the surrounding tubular where the forms use an incline of preferably 15-20 degrees and allow for measuring differential near the perforations and at the constriction location so that the flow can be computed using the Bernoulli Equation.

19 Claims, 2 Drawing Sheets

FOREIGN PATENT DOCUMENTS

| | | |
|---|---|---|
| EP | 0370548 | 5/1990 |
| WO | 8902066 | 3/1989 |
| WO | 2006097772 | 9/2006 |
| WO | 2006127939 | 11/2006 |
| WO | 2007027080 | 3/2007 |
| WO | 2007034131 | 3/2007 |

OTHER PUBLICATIONS

Baker Hughes Production Quest product information on SureFlo-InForm; 2006, 2 pages.
Baker Hughes Production Quest product information on SureFlo-FB 2006, 3 pages.

* cited by examiner

COAXIAL ELECTRIC SUBMERSIBLE PUMP FLOW METER

FIELD OF THE INVENTION

The field of the invention relates to flow measurement and more particularly to flow measurement downhole associated with a venturi supported by an electric submersible pump.

BACKGROUND OF THE INVENTION

Various types of flow meters exist for downhole applications and for use with electric submersible pumps (ESP) in particular. Electromagnetic flow meters have been used on the production tubing or the surface tubing leading from the discharge of an ESP as illustrated in U.S. Pat. No. 7,258,164. Variable orifice valves with pressure sensors on opposed sides of the variable orifice have been used to detect flows in a multi-zone wellbore as illustrated in U.S. Pat. No. 6,860,325. Multiphase flow meters have been used with an ESP in combination with artificial neural networks as described in U.S. application Ser. No. 12/133,704 filed Jun. 8, 2008. Venturi meters for multi-phase flow as part of a tubular string are offered by Baker Hughes Production Quest under the Sure-Flo-FB, SureFlo-In-Form and the Sure Flo-V product lines. Other flow measurement device that use the venturi principle for strings extending downhole are illustrated in U.S. Pat. Nos. 7,107,860; 5,736,650 (assembly inserted in a drill stem test string); U.S. Pat. Nos. 5,693,891; 6,935,189 (multi-phase venturi flow meter); U.S. application Ser. No. 12/127,232 filed May 27, 2008 having a tile of Method of Measuring Multi-Phase Flow shows the use of a two stage flow meter; and SPE 110319 entitled Inverted Venturi: Optimizing Recovery Through Flow Measurement shows creation of a venturi meter by increasing the pipe diameter as opposed to an internal constriction that is more commonly used in venturi meters.

Also relevant to downhole flow measurement using venturi or Pitot principles or others are: US Applications 2007/0193373; 2003/0192689; 2006/0196674; 2003/0010135; U.S. Pat. Nos. 4,839,644; 4,928,758; 6,755,247 and EP 0235032; WO 8902066.

Typical ESP installations involve a motor supported below a pump with an enclosure (typically a sensor system) that is cylindrically shaped that is in turn supported below the motor and is no larger than the motor. A power cable runs from the surface to the motor and via the Y point on the bottom of the motor to the enclosure, known as a gauge, has sensors in it to track the performance of the ESP motor among other functions. The data accumulated in the gauge is communicated to the surface through the power cable that is connected to the ESP motor. Normally the data is transmitted as a direct current signal on the neutral Y point of the power cable that powers the motor with alternating current. Instrumentation on the surface (chokes or capacitors) to form a Y point to discriminate between the data signal and the power feed to the motor so that the data can be interpreted at the surface in real time. The power cable is typically run to the surface without connections or splices downhole for greater reliability where data is decoded and fed into a surface control system. Transposition splices may occur to help balance power for flat cable configurations.

The present invention uses the wellbore casing as part of the venturi device that is supported below the ESP motor and located below in the inlet side of the ESP. The gauge can receive an exterior sleeve to create the venturi device within the casing. The gauge needs only minor modifications to collect the needed pressure drop data and communicate it to the power cable for the ESP for transmission to the surface. These and other features of the present invention will be more apparent to those skilled in the art from a review of the detailed description of the preferred embodiment and the associated drawings while recognizing that the appending claims define the full scope of the invention.

SUMMARY OF THE INVENTION

An (inverse) venturi structure is supported below an ESP preferably on or near its gauge assembly below the motor or alternatively directly on the pump and motor assembly so that the surrounding casing or wellbore defines the venturi path leading to the suction connection of the ESP. The ESP can be mounted with the pump on top or motor on top as long as the flow to the pump passes the gauge venturi or ESP assembly mounted venturi. Multiple (at least two) pressure sensing locations are provided in case the gauge that defines the venturi path is disposed off center in the bore or if the bore is on an incline. The gauge or ESP assembly can receive sleeves of different sizes depending on the size of the surrounding tubular where the sleeves use an incline of preferably 15-20 degrees and allow for measuring differential above the perforations and at the constriction location so that the flow can be computed using the Bernoulli Equation. A centralizer can add turbulence and improve measurement accuracy.

DETAILED DESCRIPTION OF THE PREFERRED EMBODIMENT

Figure 1:
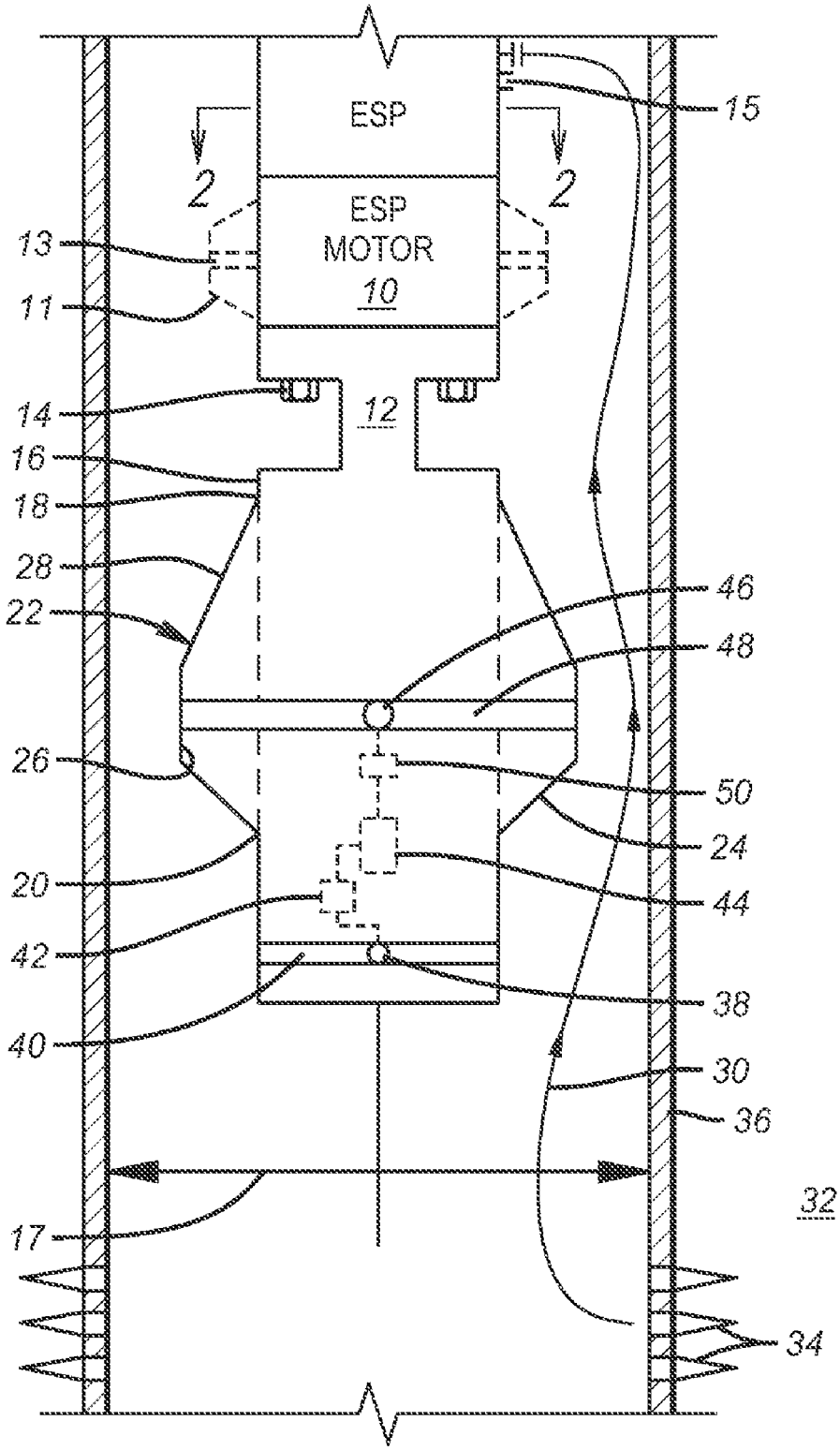
FIG. 1 is a schematic assembly view showing in elevation the location of the venturi on the gauge below the ESP pump motor or in dashed lines on the ESP assembly itself.

Referring to FIG. 1, the motor 10 for the ESP supports a gauge 12 using fasteners 14. The gauge has a cylindrical side wall 16 and an exterior thread at location 18 or 20 to which a form 22 can be attached. Sleeve 22 has surface 24 which is preferably sloped at 15-20 degrees to the cylindrical surface 16. Surface 26 is adjacent surface 24 and preferably has no slope. Surface 28 is adjacent surface 26 and allows for pressure recovery of the flowing fluid stream represented by arrow 30 that moves from the formation 32 through perforations or other openings 34 in the casing or liner 36. While sleeve 22 can be an add on or integral to the gauge 12 it can also be a shape integral or added to the assembly of the ESP with the motor 10 and preferably mounted to the motor 10. As shown in dashed lines in FIG. 1 sleeve 11 has taps 13 at the constriction and additional taps 15 preferably above the motor 10 but an alternative location below the motor 10 for taps 15 is also contemplated.

The gauge 12 has preferably several interconnected pressure taps 38 with the preferred number being four at 90 degree intervals and all connected by a circular passage 40. Taps 38 lead to one or more pressure sensors 42 that in turn communicate with a signal transmitter or local processor 44 for either local computation of flow or transmission of the raw data to a surface processor (not shown) for computing the flow rate at the surface. The pressure tap or taps 38 measure essentially the pressure at the openings or perforations 34 even though the taps 38 are in an annular space below sleeve 22. Taps 46 are similarly connected by a ring passage 48 and exit sleeve 22 at surface 26 and a pressure sensor 50 communicates to the taps 46. The sensed pressure goes to the transmitter/processor 44 or to the surface in the same way as the measured signal at sensor 42. Data from the gauge is communicated internally to a wire connected to the Y point of the motor. Alternatively, processor 44 can send data to the surface on a TEC cable (not shown) apart from the power cable for the motor 10.

A centralizer shown schematically as 17 can be located between the perforations 34 and the constricted portion of flow path 30 so as to centralize the sleeve 22 or 11 or the integral shape that accomplishes the venturi flow path so that the readings are more accurate at the discrete taps at the same location in the well and to further enhance accuracy by increasing turbulence which increases the Reynolds number of the flowing fluid represented by arrow 30.

The end result is that the sleeve 22 that is attached to the gauge 12 or alternatively sleeve 11 creates a venturi flow path through which the flow represented by arrow 30 passes through with enough pressure drop between taps 38 and 46 that can be reliably measured by sensors 42 and 50. Depending on the size of the casing or other tubular 36 different sleeves 22 can be attached at 18 or 20 or to motor 10 using engaging threads or other types of attachment. In that way a common size of gauge 12 can be used for a variety of casing or tubular 36 sizes. The slope of surface 28 can be significantly less than surface 24 to aid in pressure recovery of the fluid stream represented by arrow 30. Slopes as low as a few degrees can be used for surface 28 assuming there is enough height available for the cylindrical surface 16 of the gauge 12.

Figure 2:
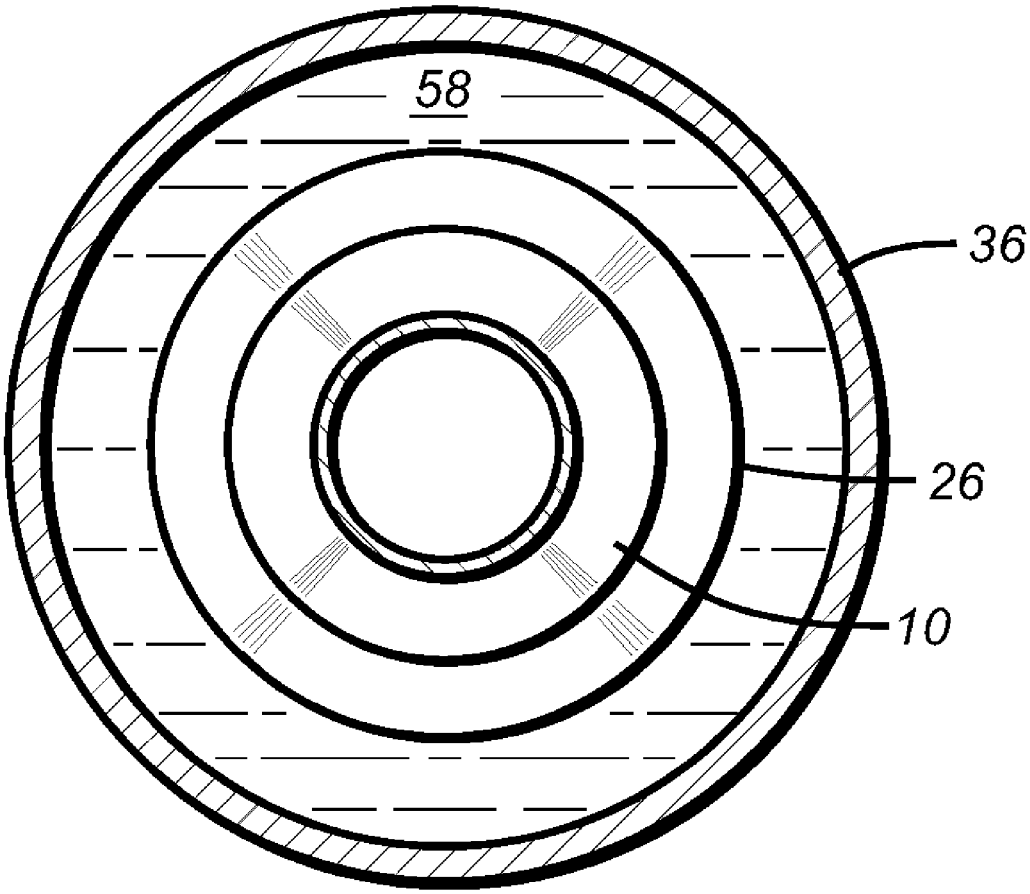
FIG. 2 is the view along lines 2-2 of FIG. 1.

FIG. 2 shows in plan view the flow area 58 defined by surface 26 and the surrounding casing or tubular 36.

Those skilled in the art will appreciate the advantages of having a venturi created about the cylindrical surface 16 using the selection of sleeves 22 or 11 depending on the size of the casing or tubular 36. The gauge is already there with the ESP and has other instrumentation already mounted inside in a manner shielded from the surrounding environment. By simply adding two pressure sensors to communicate with taps 38 and 46 and further connection to the junction 54 there is established an economical venturi without additional external lines that can be damaged during run in or that could limit the ability of the assembly to clear a given drift diameter in tubular 36. It should be noted that the sleeves 22 can carry the pressure sensor 50 or it can be within the gauge 12. Seals (not shown) can also be used apart from the connections at 18 and 20 which are preferably threaded but other types of securing devices can be used within the scope of the invention.

The above description is illustrative of the preferred embodiment and many modifications may be made by those skilled in the art without departing from the invention whose scope is to be determined from the literal and equivalent scope of the claims below.

We claim:

1. An electric submersible pump assembly for downhole use in a wellbore defined by a wall to pump fluids to a surface through a tubular string, comprising:

a motor driven pump assembly supported by the tubular string, said pump assembly pumping a fluid stream through the tubular string;

a gauge housing supported by said motor driven pump assembly and shaped to define a venturi flow path between said gauge housing and the surrounding wellbore wall or an outermost surface on said motor driven pump assembly that defines a venturi flow path between said outermost surface on said motor driven pump assembly and the surrounding wellbore wall, said venturi flow path, in either instance, comprising two sloping surfaces spaced by a non-sloping surface which allows spaced pressure measurements for computation of flow rate;

a measuring device associated with said venturi flow path to measure the fluid stream;

said fluid stream passing only externally of said gauge housing or said outermost surface on said motor driven pump assembly up to an entry location on a pump of said pump assembly.

2. The assembly of claim 1, wherein:

said motor driven pump assembly has a cylindrical shape and said gauge housing defines said venturi flow path in the form of a sleeve mounted onto said cylindrical shape.

3. The assembly of claim 2, wherein:

said form has at least one first pressure tap extending to an outer periphery.

4. The assembly of claim 3, wherein:

said at least one first pressure tap comprises a plurality of interconnected taps.

5. The assembly of claim 3, wherein:

a first said sloping surface engaged by flow between said form and the wellbore wall is sloped at 15-20 degrees from the cylindrical wall of said housing.

6. The assembly of claim 5, wherein:

the second said sloping surface engaged by flow between said form and the wellbore wall has a lesser slope than said first sloping surface.

7. The assembly of claim 6, wherein:

said housing further comprises at least one second tap to sense pressure of the flowing stream before it reaches said first sloping surface.

8. The assembly of claim 7, wherein:

said motor driven pump assembly further comprising a power cable extending along the tubular string from the surface to said gauge housing;

at least one of the sensed pressure at said taps and the computed flow rate using pressure sensed at said taps by a processor mounted in said housing are sent to the surface through said power cable.

9. The assembly of claim 3, wherein:

said sleeve further comprises a pressure sensor associated with said tap.

10. The assembly of claim 2, wherein:

said sleeve is secured with a threaded connection to said gauge housing.

11. The assembly of claim 1, wherein:

said motor driven pump assembly further comprising a power cable extending along the tubular string from the surface to said gauge housing or said gauge housing has data communication with the surface via a wire independent of said power cable;

said gauge housing comprises at least two spaced pressure taps and pressure sensors in communication with said venturi flow path to communicate at least one of sensed pressures or computed flow using said sensed pressure and a processor in said housing through said power cable.

12. The assembly of claim 11, wherein:

said gauge housing has at least one first pressure tap extending to an outer periphery that defines the largest diameter of said gauge housing.

13. The assembly of claim 12, wherein:

said at least one first pressure tap comprises a plurality of interconnected taps.

14. The assembly of claim 12, wherein:

said three adjacent surfaces comprise two sloping surfaces separated by a middle surface that has no slope with respect to a cylindrical shape of said gauge housing.

15. The assembly of claim 14, wherein:

a first said sloping surface engaged by flow between said projection and the wellbore wall is sloped at 15-20 degrees from said cylindrical wall of said gauge housing.

16. The assembly of claim 15, wherein:

the second said sloping surface engaged by flow between said form and the wellbore wall has a lesser slope than said first sloping surface.

17. The assembly of claim 16, wherein:

said gauge housing further comprises at least one second tap to sense pressure of the flowing stream before it reaches said first sloping surface.

18. The assembly of claim 1, further comprising:

a centralizer supported at a spaced location from said gauge housing.

19. The assembly of claim 18, wherein:

said centralizer is in a path leading to said venturi flow path to increasing flow turbulence in said venturi flow path.

* * * * *